United States Patent [19]

Araki

[11] Patent Number: 4,467,592

[45] Date of Patent: Aug. 28, 1984

[54] METHOD AND APPARATUS FOR CONTROLLING THE ROVING TAKE-UP TENSION IN A ROVING MACHINE

[75] Inventor: Hidejiro Araki, Toyoake, Japan

[73] Assignee: Kabushiki Kaisha Toyoda Jidoshokki Seisakusho, Kariya, Japan

[21] Appl. No.: 427,189

[22] Filed: Sep. 29, 1982

[30] Foreign Application Priority Data

Oct. 12, 1981 [JP] Japan ..... 56-162219

[51] Int. Cl.[3] ..... D01H 1/26

[52] U.S. Cl. ..... 57/96; 57/98; 57/264

[58] Field of Search ..... 57/92–96, 57/98, 99, 264, 81, 265

[56] References Cited

U.S. PATENT DOCUMENTS 3,986,330 10/1976 Kuttruff et al. ..... 57/94
4,056,926 11/1977 Stuber ..... 57/264 X
4,134,253 1/1979 Handa et al. ..... 57/96
4,168,604 9/1979 Mannhart ..... 57/264
4,375,744 3/1983 Briner et al. ..... 57/96

*Primary Examiner*—John Petrakes
*Attorney, Agent, or Firm*—Brooks Haidt Haffner & Delahunty

[57] ABSTRACT

Described is a bobbin lead roving machine in which target r.p.m. values for the bobbin are found in advance for each of arbitrarily selected numbers of the layers of the roving taken up on the bobbin and are stored in a micro-compouter, there r.p.m. values are compared to actual r.p.m. values for respective ones of said arbitrarily numbers of the layers, and compensation is made automatically for any offsets resulting from such comparison for causing the r.p.m. of the bobbin to be within a control limit, in a manner that the take-up tension placed on the roving is kept constant during spinning since the beginning until the end of winding on the bobbin for producing the roving of uniform weight (with a constant weight/unit length).

9 Claims, 4 Drawing Figures

METHOD AND APPARATUS FOR CONTROLLING THE ROVING TAKE-UP TENSION IN A ROVING MACHINE

BACKGROUND OF THE INVENTION

This invention relates to a bobbin lead roving machine and more particularly to a method for controlling the take-up or winding tension placed on the roving through adjustment of the r.p.m. of the bobbin, and an apparatus for carrying out such method.

In a roving machine, the rate of increase in the bobbin diameter relative to the increase in the number of roving layers on the bobbin is changed with spinning conditions such as the kind and weight of the fibers to be roved, the r.p.m. of the flyer, or the number of twists. Thus, when a single set of cone drums are used, it is difficult to adjust the roving machine so that the roving take-up tension may be constant from the beginning until the end of winding on a bobbin under any spinning conditions. Since fluctuations in the roving tension may cause fluctuations in the weight of the roving and in the number of roving, higher skill and experience on the part of the operators are required for adjusting the tension placed on the roving to an optimum value.

So far, various methods and devices have been proposed to effect the roving operation under a constant roving tension. Thus the devices shown in the Japanese Patent Publication No. 48652/1977 and the Japanese Utility Model Publication No. 13376/1977 are being used practically in a roving machine making use of cone drums as means for changing the speed of rotation of the bobbin. In known devices, a tentative roving operation is performed under given spinning conditions. During such tentative spinning, the state of tension on the roving travelling between the front roller and the flyer top is checked several times from the beginning until the end of winding for adjusting the cone drum belt shift compensation device and changing the cone drum belt position by means of a belt shifter. When the desired r.p.m. of the bobbin is reached, the position of the belt shifter of the compensation device is set for fixing the relation between the number of the roving layers and the corresponding cone drum belt position or displacement. The actual spinning operation is contemplated to be performed under a constant roving tension by observing the above relation during spinning.

In this known method, the relation between the number of the roving layers and the cone belt position is fixed on the assumption that the relation between the cone drum belt position and the r.p.m. of the bobbin can be fixed unequivocally by thus fixing the relation between the number of the roving layers and the belt position. However, the same r.p.m. of the bobbin may not be necessarily obtained for the same belt positions because of other factors such as changes in the load status, decrease in the power of transmission due to prolonged use of the transmission belt, and changes in belt tension.

It is therefore a principal object of the present invention to provide a method and apparatus for controlling the take-up tension on the roving whereby the tension on the roving may be kept constant under any spinning conditions or states of the roving machine.

SUMMARY OF THE INVENTION

With the above object in view, this invention resides in a method for controlling the roving take-up tension in a bobbin lead roving machine comprising the steps of finding in advance a target r.p.m. (N°n) of the bobbin for each of a plurality of arbitrarily selected layers (n) taken up on a bobbin and setting plural sample sets of (N°n)-(n) in a micro-computer; finding by automatic measurement an actual r.p.m. (Nn) of the bobbin for each of the layers (n) in the subsequent actual spinning; comparing the target values (N°n) to the actual values (Nn) in said micro-computer for respective ones of the layers (n) and issuing, in case the resulting difference has exceeded the present control limit value, a signal for correcting the actual r.p.m. towards said target r.p.m., thereby to speed up or slow down the bobbin rotation for automatically compensating the take-up tension on the roving.

Furthermore, the present invention resides in a device for controlling the roving take-up tension in a bobbin lead roving machine, said device comprising a sensor for measuring the r.p.m. of the bobbin; means for counting the number of layers of the roving; a micro-computer designed to receive the outputs from said sensor and counting means to compare said outputs with the values of the r.p.m. of the bobbin related to preset ones of the roving layers and to issue a compensation signal when the result of such comparison has exceeded a preset control limit value; relaying means operable in response to said compensation signals; and means responsive to actuation of said relaying means to change the r.p.m. of the bobbin.

BRIEF DESCRIPTION OF THE DRAWINGS

While the specification concludes with claims specifically pointing out and distinctly claiming the subject matter of the invention, it is believed that the invention will be better understood from the following description taken in conjunction with the accompanying drawings, wherein:

DESCRIPTION OF THE PREFERRED EMBODIMENT

For providing a constant roving tension, it is necessary in a known manner to control the r.p.m. of the bobbin to provide roving take-up speeds related to variations in the number of roving layers or in the bobbin diameter.

Roving tension is changed with the spinning speed to take-up speed ratio, resistance offered from the flyer to the roving and the status of roving. Thus it is difficult to set the roving tension by an advance operation such as calculation. According to conventional practice, the relative position between the upper and lower cone drums, the starting belt position and the belt displacement per roving layer are set by a skilled practitioner as he checks the status of the roving travelling between the front roller and the flyer top to eliminate excess tension or slack in the roving for possibly arriving at the optimum status of the roving and the appropriate r.p.m. of the bobbin. However, it is difficult to satisfy varying spinning conditions with a given set of cone drums of a specific configuration. Thus, according to the method of the present invention, a tentative spinning operation is performed with the roving of a given description. In the course of this tentative spinning, the roving tension is adjusted to occasional optimum values for various numbers n of the roving layers on the bobbin, where n designates integers 1, 2, 3 . . . , and the r.p.m.'s of the bobbin corresponding to these optimum values of the roving tension N°n where n designates integers 1, 2, 3 . . . . The relation between the number of roving layers n and the corresponding r.p.m.'s of the bobbin is stored in a micro-computer. Such relation need not be taken for each layer of the roving on the bobbin. As a matter of fact, it is only necessary to take such relation for a suitable plural number of the layers during spinning from the beginning until completion of winding. In this case, the relation between the number of layers n and the bobbin r.p.m. N°n may be directly inputted to the micro-computer for the roving of a specific description. Alternatively, the relation between n and N°n is recorded in advance and the relation thus recorded is inputted occasionally to the micro-computer so as to be used in a subsequent spinning operation which is to be effected under the same spinning conditions. Still alternatively, the relation between n and N°n is stored in advance in a micro-computer for each of plural descriptions of the roving so that a desired one of such relations may be resorted to when the occasion may demand. The preparatory step for the actual spinning is now completed.

Figure 1:
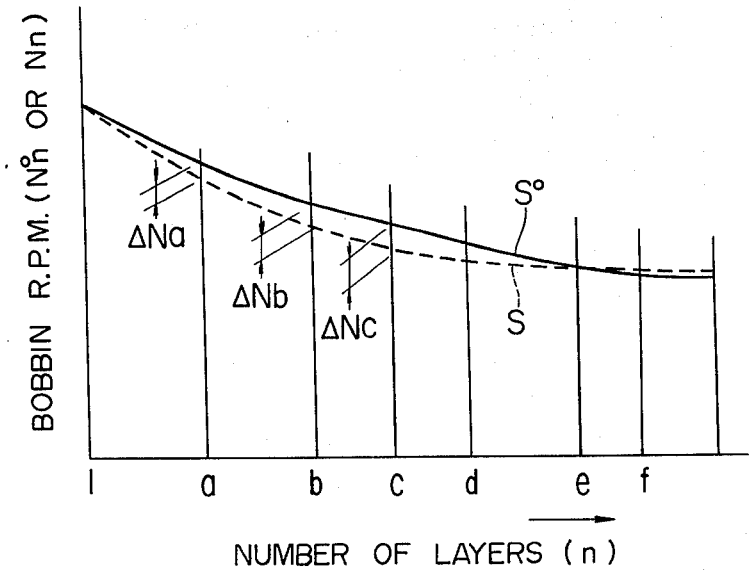
FIGS. 1 and 2 are diagrams showing the numbers of layers of the roving on the bobbin versus the r.p.m. of the bobbin for illustrating the process of controlling the r.p.m. of the bobbin according to the present invention.
Figure 2:
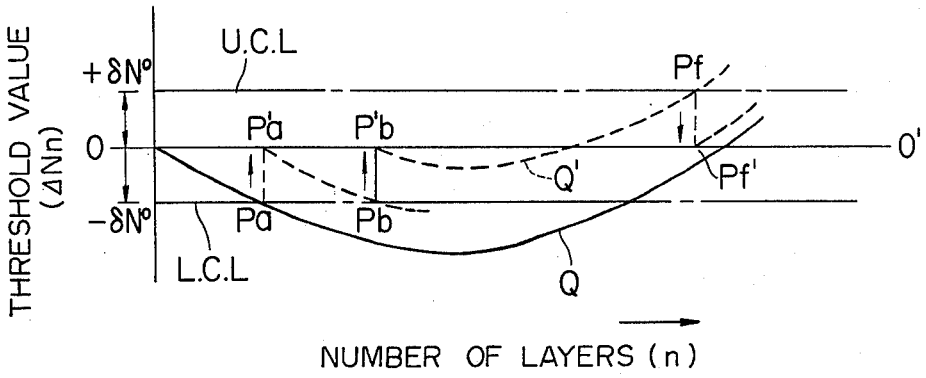

The control process for the bobbin r.p.m. in the course of the actual spinning operation is now described in detail. It is assumed that Nn designates the bobbin r.p.m. as measured for a certain number of the roving layers n. The value Nn is inputted to the micro-computer for comparison with the stored value N°n, and a signal is issued when the resulting difference has exceeded a preset control threshold value. This signal is used for driving a bobbin speed compensation electric motor through an output relay for automatically changing the bobbin r.p.m. N° in the direction of the preset r.p.m. N°n for realizing the targeted roving tension. Such change of the bobbin r.p.m. in the desired direction may be effected by advancing or receding the belt position in case of a roving machine having a cone drum type speed change system, or by increasing or decreasing the rotary angle of a speed change cam in case of a roving machine having a positive infinitely variable (P.I.V.) speed change system. FIGS. 1 and 2 illustrate the process for controlling the r.p.m. of the bobbin. In FIG. 1, the numbers n of the roving layers are plotted on the abscissa, where a, b, c, . . . designate the numbers of layers stored in the micro-computer. The r.p.m.'s of the bobbin N°n, Nn are plotted on the ordinate. In these Figures, a curve So represents the design setting of the bobbin r.p.m. for the various numbers of the layers, while a curve S the changes of the bobbin r.p.m. for the various numbers of the layers when the bobbin r.p.m. is not placed under control. ΔNa, ΔNb, ΔNc . . . designate offsets of Nn from N°n for the numbers of layers a, b, c, . . . . In FIG. 2, the relation between the numbers of the layers n and the magnitude of the above offset is shown to an enlarged scale about the preset bobbin r.p.m. as reference. In this Figure, the numbers n are plotted on the abscissa and the offset ΔNn is plotted on the ordinate. 00' represents the preset bobbin r.p.m.. An upper control limit (U.C.L.) and a lower control limit (L.C.L.) represent the control limit threshold values $+\delta N°$ and $-\delta N°$. A curve Q shown in solid line represents a change in ΔNn when the bobbin r.p.m. is not placed under control. A curve Q' shown in dotted line represents a similar change that takes place when a device for compensating the bobbin r.p.m. is in operation. Referring to this curve Q', when the micro-computer has detected that the offset ΔNn has exceeded at Pa the lower control limit line at number a, the device for compensating the bobbin r.p.m. comes into operation for compensating the bobbin r.p.m. towards the central setting 00' at P'a. The curve Q' then proceeds similarly to the curve Q from P'a to Pb and again exceeds the lower control limit line at Pb at number b. Bobbin r.p.m. is again compensated at this point. The bobbin r.p.m. is controlled to be within the predetermined control limit by repeating the foregoing process steps.

Figure 3:
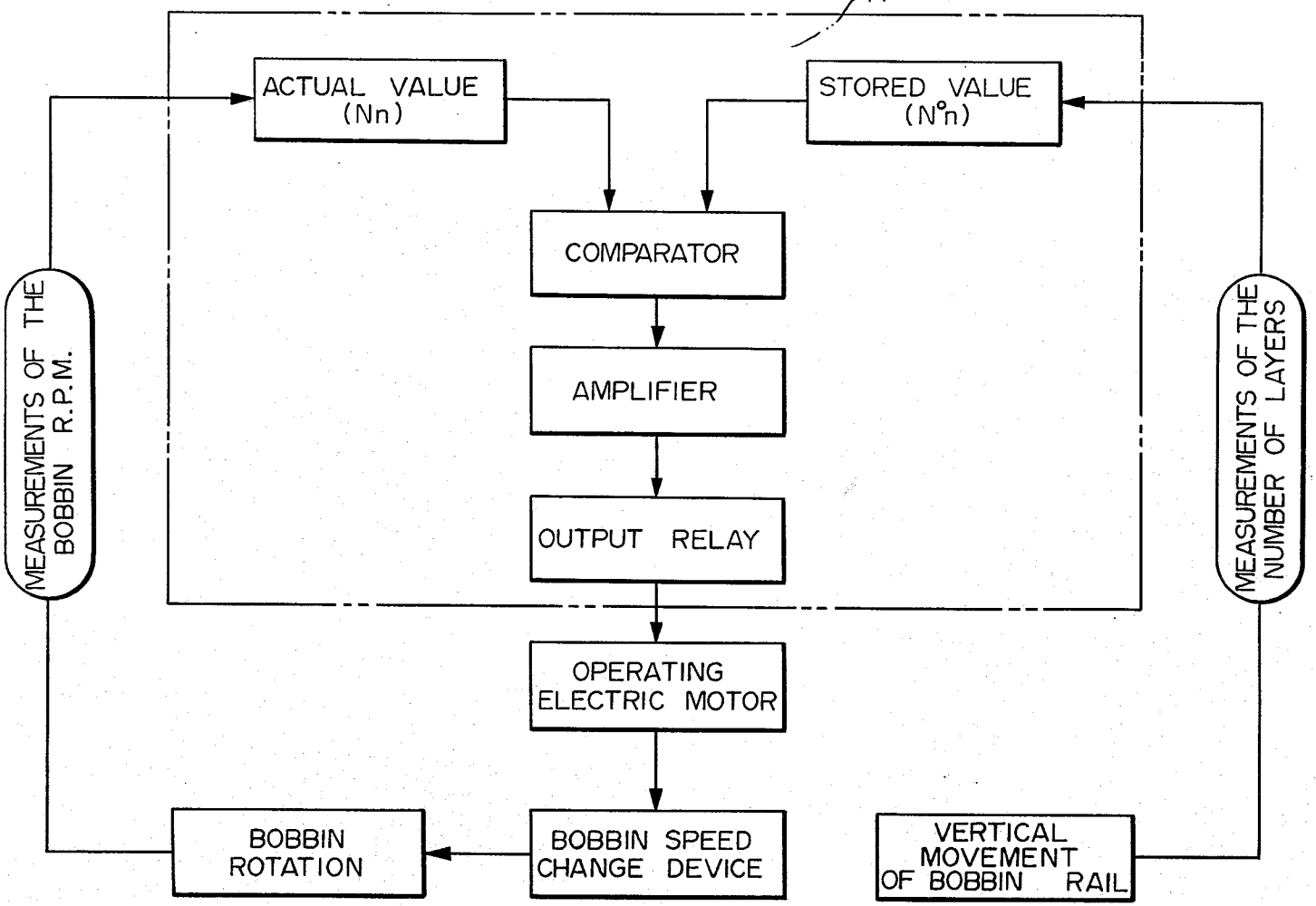
FIG. 3 is a block diagram for illustrating the same process.

FIG. 3 is a block diagram for control of the bobbin r.p.m. where A shown in double-dotted chain line designates a micro-computer section. The control limit for the bobbin r.p.m. for a predetermined number n of the roving layers where n designates any arbitrary number from unity to a maximum number of the roving layers to be wound on the bobbin, expressed as a, b, c, . . . . In FIG. 2, this control limit is shown as design setting level. The number n is measured by a measuring device on the basis of the vertical movement of the bobbin rail and inputted into the micro-computer. The control part of the micro-computer operates only when the inputted number n has coincided with the number a, b, c, . . . previously stored in the computer. The actual r.p.m. of the bobbin Nn is measured by a measurement device and inputted to the micro-computer. A signal is issued for each of the numbers a, b, c, . . . from a comparator and amplified. The signal thus amplified operates to drive the operating electric motor in the forward or reverse direction through the output relay for compensating the bobbin r.p.m. by operation of a bobbin speed change device. The bobbin r.p.m. resulting from such compensation is again measured and inputted to the micro-computer according to feedback control mode.

Figure 4:
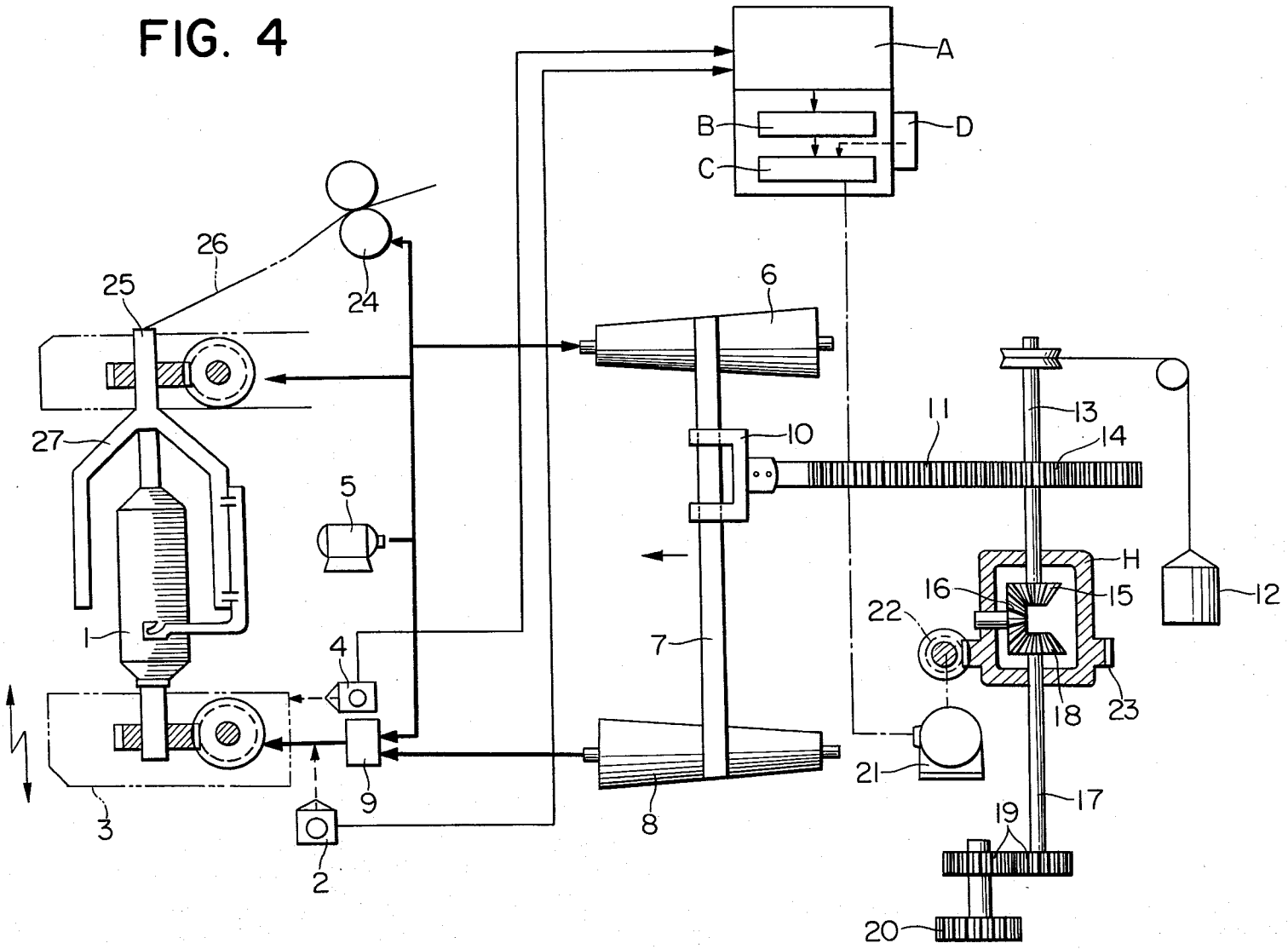
FIG. 4 shows the overall roving tension control device according to a preferred embodiment of the present invention.

Reference is made to FIG. 4 for illustrating an embodiment of a device for carrying out the method of the present invention, as applied to a roving device having a bobbin speed change device making use of a pair of cone drums as conventionally. In a bobbin lead roving machine, the roving is taken up on the basis of the difference between the r.p.m. of a bobbin 1 and that of a flyer 27 which is less than that of the bobbin. A sensor 2 for sensing the bobbin r.p.m. is mounted in a drive system for the bobbin 1 for measuring the actual bobbin r.p.m. which is inputted into the micro-computer A. The means for measuring the number n is a counter 4 making use of a non-contact relay or a microswitch that is turned on or off based upon vertical travel of a bobbin rail 3. The bobbin 1 is rotated with a variable speed under a combined rotary motive power supplied from a differential device 9 to which are supplied a rotary power from a main electric motor 5 and a rotary power from a bottom cone drum 8, which is rotated from the main motor 5 through a top cone drum 6 and a transmission belt 7 with a variable speed related to the bobbin diameter. Referring to an embodiment of the bobbin speed change device, there is shown in FIG. 4 a system for displacing the transmission belt 7 associated with the cone drums. In this system, a differential gearing H is annexed to the conventional belt shifter device for providing the conventional belt shifting and the compensation belt shifting simultaneously. Referring to the conventional belt shifting, a rack 11 having a belt shifter 10 meshes with a gear 14 on a shaft 13 that is rotated in a known manner by descent of a weight 12. The gear 14 is connected to a gear 16 mounted on the same shaft 13, a planetary gear 16, a gear 18 on a shaft 17 aligned with shaft 13, and a ratchet wheel 20 connected in turn to the shaft 17 through pinions 19. Whenever a pawl, not shown, engaging with the ratchet wheel 20 is disengaged due to a change in the number of roving layers, the gear 14 is rotated intermittently for displacing the belt 7 a predetermined distance in the direction shown by the arrow mark so as to change the number of revolutions of the cone drum 8 and thereby change the r.p.m. of the bobbin. On the other hand, when the offset ΔNn of the r.p.m. of the bobbin has exceeded the control limit, the operating electric motor 21 forming an essential portion of the device for controlling the r.p.m. of the bobbin is rotated in the forward or reverse direction to effect compensation belt shifting. A worm 22 meshing with a worm wheel 23 is rotated by rotation of the motor 21 for rotating the planetary gear 16 about axes of the aligned shafts 13, 17. Since the shaft 17 is stationary by operation of the ratchet wheel 20 and the pawl meshing therewith, rotation of the gear 16 causes rotation of the shaft 13 and thereby the belt 7 is advanced or receded a predetermined distance through gear 14, rack 11 and belt shifter 10 to effect the compensation of the r.p.m. of the bobbin. It is to be noted that any other means or devices for compensation belt shifting than the one shown and described in the above may be applied to the present invention.

The method for setting the r.p.m. of the bobbin N°n with relation to the number of roving layers on the bobbin is now described with reference to the drawings. In FIG. 4, A, B and C designate micro-computer section, amplifier section and output relay section, and D designates a manual switch section for the operating electric motor 21. During trial spinning, the state of tension on the roving 26 travelling between a front roller 24 and a flyer top 25 is judged on the basis of slack in the roving 26. If the tension state is judged to be inadequate, the switch D is operated for driving the motor 21 and adjusting the position of the belt 7 so as to change the r.p.m. of the bobbin 1. When the tension on the roving is judged to be optimum, the r.p.m. of the bobbin N°n prevailing at this time is stored in the micro-computer as a sample set with the corresponding number of the layers n previously stored in the micro-computer. By repeating this procedure from the beginning until the end of winding of the roving on the bobbin, design values of the r.p.m. of the bobbin N°a, N°b, N°c, . . . coordinated to the number of layers a, b, c, . . . can be stored in the micro-computer. A control limit value δN°n for the offset ΔNn is then stored in the micro-computer. The actual spinning operation is then performed in the manner described above. Display means for the numbers of the layers n, design r.p.m. N°n and actual r.p.m. may preferably be included in the micro-computer.

Although the foregoing description has been made in connection with a roving machine employing a pair of cone drums, the present invention can be applied to a roving machine having a bobbin r.p.m. control device in which an operating cam is associated with a PIV speed change system. According to the control method of the present invention, a linear cone drum can be used instead of the conventional hyperboloid cone drum to obviate manufacture difficulties.

The present invention may be distinguished from the conventional method in which the r.p.m. of the bobbin is controlled indirectly through controlling the belt position according to the program setting in that the number of layers on the bobbin and the r.p.m. of the bobbin are measured as sample sets in accordance with the setting program for the r.p.m. of the bobbin for directly controlling the r.p.m. of the bobbin. Thus a micro-computer may be utilized for calculation of the offsets in the r.p.m. of the bobbin. In this manner, an optimum tension may be maintained on the roving under any spinning conditions and operating states of the roving machine.

What I claim is:

1. A method for controlling the roving take-up tension in a bobbin lead roving machine with the aid of a microcomputer, comprising the steps of:

determining in advance a target rotational speed (N°n) of the bobbin for each of a plurality of arbitrarily selected layers (n) taken up on a bobbin and storing plural sample sets of (N°n)-(n) in said micro-computer;

measuring the actual rotational speed (Nn) for each of the layers (n) in the subsequent actual spinning;

comparing the target value (N°n) to the actual value (Nn) in said micro-computer for respective ones of the layers (n); and issuing, in case the resulting difference has exceeded the preset control limit value, a signal for correcting the actual rotational speed (Nn) towards said target rotational speed, thereby to speed up or slow down the bobbin rotation for automatically compensating the take-up tension on the roving.

2. An apparatus for controlling the roving take-up tension in a bobbin lead roving machine, said apparatus comprising:

a sensor for measuring the rotational speed of a bobbin;

means for counting the number of layers of the roving;

a micro-computer designed to receive and count outputs from said sensor and said counting means to compare said outputs with the values of the rotational speed of the bobbin related to preset ones of the roving layers, said micro-computer issuing a compensation signal when the result of such comparison has exceeded a preset control limit value;

relaying means operable in response to said compensation signal; and means responsive to actuation of said relaying means to change the rotational speed of the bobbin.

3. The apparatus according to claim 2, wherein said counting means comprises a microswitch turned on and off by vertical movement of a bobbin rail.

4. The apparatus according to claim 2, wherein said counting means comprises a non-contact relay operated by vertical movement of a bobbin rail.

5. The apparatus according to claim 2, wherein the roving machine has a bobbin driving mechanism comprising a pair of cone drums, an endless belt placed around the cone drums, and means associated with said endless belt for changing the belt position on said cone drums, and wherein means for controlling the rotational speed of the bobbin comprises an electric motor associated with belt position changing means through a differential gear.

6. The apparatus according to claim 5, wherein said relaying means is connected to a manual switch for manually switching said electric motor.

7. The apparatus according to claim 5, wherein the cone drums are linear cone drums.

8. A method for controlling the roving take-up tension in a bobbin lead roving machine having a bobbin driving mechanism for receiving and rotating a bobbin including means for controlling the rotational speed (Nn) of said bobbin and having flyer means for feeding a roving to a said bobbin to be taken-up thereon in layers (n) which comprises:

determining the rotational speed (N°n) of said bobbin providing optimum roving take-up tension for each of a plurality of arbitrarily selected layers (n) of roving take-up on a said bobbin;

operating said bobbin lead roving machine to take-up roving from said flyer means on a said bobbin by rotation of said bobbin;

measuring the rotational speed (Nn) of said bobbin during take-up of said roving on said bobbin for each layer (n) of said roving on said bobbin;

comparing the predetermined optimum value of bobbin rotational speed (N°n) to the measured rotational speed (Nn) of said bobbin for each layer (n) of roving taken up on said bobbin for which such optimum value (N°n) has been determined to establish the difference (Nn); and adjusting the rotational speed (Nn) to said optimum rotational speed (N°n) of said bobbin when said difference (Nn) exceeds a preset control limit value ( N°n).

9. A method according to claim 8 in which said optimum rotational speed (N°n) of said bobbin is determined by observation of slack in said roving between the front roller and flyer top of said bobbin lead roving machine.

* * * * *